US006502550B1

(12) United States Patent
Kotwicki et al.

(10) Patent No.: US 6,502,550 B1
(45) Date of Patent: Jan. 7, 2003

(54) GASEOUS FUELED ENGINE SYSTEM AND METHOD

(75) Inventors: Allan J. Kotwicki, Williamsburg, MI (US); Siamak Hashemi, Farmington Hills, MI (US); Steven Joseph Szwabowski, Northville, MI (US); Woong-chul Yang, Ann Arbor, MI (US); Yin Chen, Dearborn, MI (US); Yong-Wha Kim, Ann Arbor, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/683,702

(22) Filed: Feb. 5, 2002

(51) Int. Cl.[7] ..... F02P 5/00
(52) U.S. Cl. ..... 123/406.47; 701/105; 73/116
(58) Field of Search ..... 123/406.53, 491, 123/179.5, 406.58, 478, 406.45, 406.47, 406.62, 476–477; 701/105; 73/116

(56) References Cited

U.S. PATENT DOCUMENTS 5,088,452 A 2/1992 Iwaki et al.
5,146,882 A 9/1992 Brinkman et al.
5,219,397 A 6/1993 Jones
6,016,789 A * 1/2000 Denz et al. ..... 123/406.62
6,257,207 B1 7/2001 Inui et al.
6,302,085 B1 * 10/2001 Sekine et al. ..... 123/406.62
6,340,016 B1 1/2002 Ueda et al.

* cited by examiner

*Primary Examiner*—Willis R. Wolfe
*Assistant Examiner*—Johnny H. Hoang

(57) ABSTRACT

An ignition and fuel control system 10 of a vehicle 18 is provided including a controller 22. The controller 22 is electrically coupled to an ignition system 14, a fuel system 16, a crankshaft position sensor 32, and a camshaft position sensor 34. The crankshaft position sensor 32 senses a crankshaft position and generates a crankshaft position signal. A camshaft position sensor 34 senses a camshaft position and generates a camshaft position signal. The controller 22 determines a crankshaft position and a camshaft position in response to the crankshaft position signal and the camshaft position signal respectively. The controller 22 identifies a reference engine cylinder in response to the crankshaft position and the camshaft position and generates a synchronization value. The controller 22 also enables the ignition system 14 and the fuel system 16 in response to the synchronization value.

9 Claims, 3 Drawing Sheets

GASEOUS FUELED ENGINE SYSTEM AND METHOD

BACKGROUND OF INVENTION

The present invention relates generally to vehicle fuel systems, and more particularly to a method and apparatus for synchronizing the fuel system, ignition system, and engine of a vehicle.

Alternative fuels have become an ever-greater concern in the search to conserve energy. The development of alternative powerplants for use in automotive vehicles is a goal of automobile manufacturers. The alternative powerplant must provide the required power needed to operate a vehicle, and at the same time be energy efficient, reduce emissions, and be cost effective. One such alternative powerplant under consideration is a hydrogen fueled internal combustion engine.

Hydrogen fueled internal combustion engines can potentially be cleaner burning and have increased fuel efficiency compared to gasoline engines. Hydrogen fueled internal combustion engines also produce nearly zero hydrocarbons, carbon monoxide, and carbon dioxide in contrast to traditional gasoline fueled internal combustion engines. Hydrogen engines can operate on a wide range of flammable mixtures. Hydrogen mixtures also have low ignition energy, so that local heating can cause undesirable ignition of the gases in the intake manifold. The wide range of flammable mixtures and low ignition energy also mean that exhaust gases can undesirably ignite any flammable mixture in the exhaust manifold. The hydrogen engine is therefore prone to undesirable exhaust detonation and intake backfiring.

It would therefore be desirable when starting and operating to have a method of operation for a hydrogen engine that prevents introduction of hydrogen fuel during times when there is no ignition spark or when that spark is improperly timed. It would also be desirable to prevent operation of the hydrogen engine when a potential environment for hydrogen ignition exits outside an engine cylinder. Proper control of hydrogen fuel introduction and ignition during vehicle operation improves performance, economy and reliability of hydrogen engines.

SUMMARY OF INVENTION

An improved gaseous fuelled engine control system for introduction of fuel and application of ignition is provided herein by the present invention. The foregoing and other advantages are provided by a method and apparatus of operating an ignition system and a fuel system of a vehicle. An ignition and fuel control system of a vehicle is provided including a controller. The controller is electrically coupled to an ignition system, a fuel system, a crankshaft position sensor, and a camshaft position sensor. The crankshaft position sensor generates a crankshaft position signal. A camshaft position sensor generates a camshaft position signal. The controller determines a crankshaft position and a camshaft position in response to the crankshaft position signal and the camshaft position signal respectively. The controller identifies reference engine cylinders in response to the crankshaft position and the camshaft position and generates synchronization values. The controller also enables the ignition system and the fuel system in response to these synchronization values.

One of several advantages of the present invention is that it prevents intake backfiring of fuel in a vehicle intake system.

Another advantage of the present invention is that it prevents fuel detonation in a vehicle exhaust system.

Yet another advantage of the present invention is that it increases the feasibility of using hydrogen as an alternative internal combustion engine fuel. The use of hydrogen fuel potentially increases fuel efficiency and engine efficiency.

The present invention itself, together with further objects and attendant advantages, will be best understood by reference to the following detailed description, taken in conjunction with the accompanying drawing.

BRIEF DESCRIPTION OF DRAWINGS

For a more complete understanding of this invention reference should now be had to the embodiments illustrated in greater detail in the accompanying figures and described below by way of examples of the invention.

DETAILED DESCRIPTION

In the following description, various operating parameters and components are described for one constructed embodiment. These specific parameters and components are included as examples and are not meant to be limiting.

While the present invention is described with respect to an apparatus and method for synchronizing an ignition system and a fuel system of a vehicle the following apparatus and method is capable of being adapted for various purposes and is not limited to the following applications: gasoline powered vehicles, gaseous powered vehicles including hydrogen power vehicles, hybrid vehicles, or other vehicle and non-vehicle applications.

Figure 1:
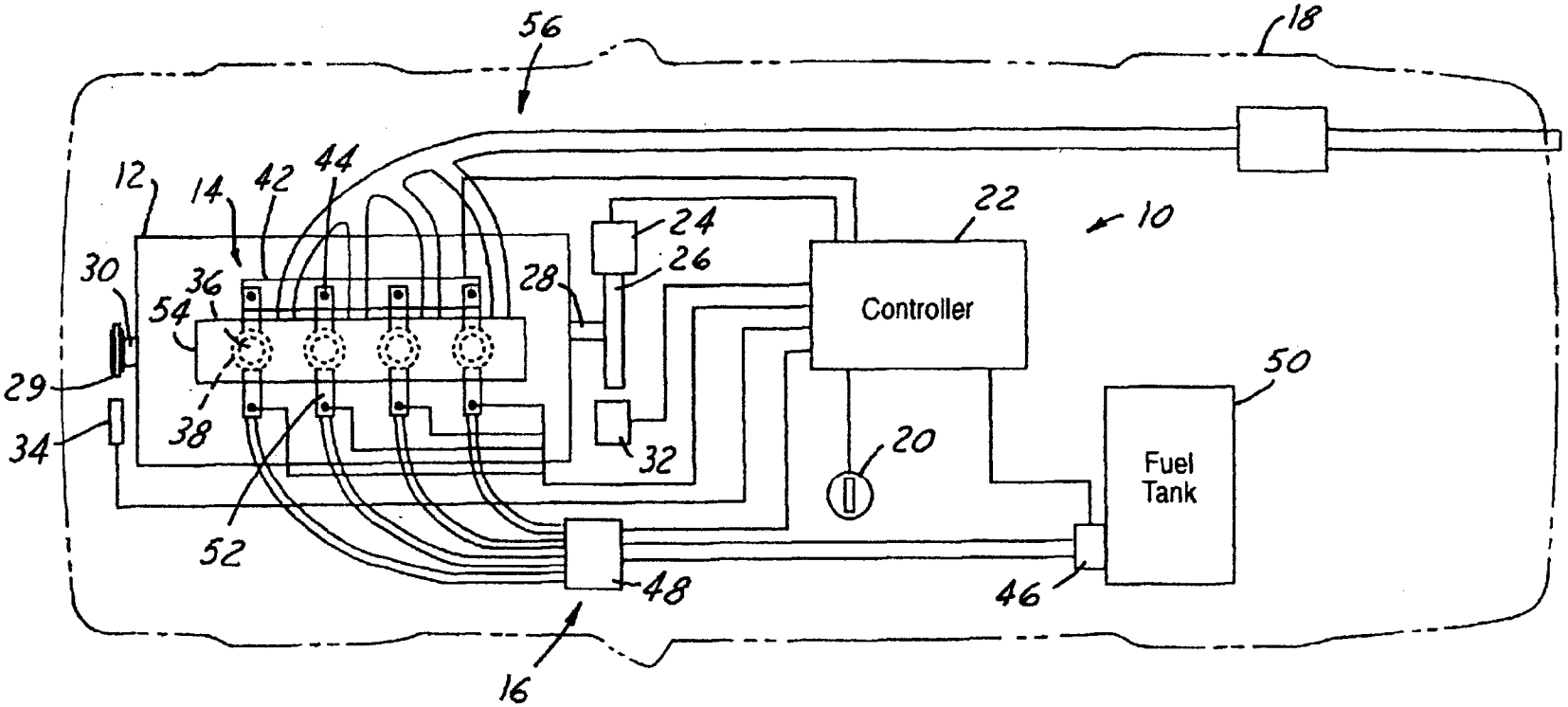
FIG. 1 is a schematic block diagram of an ignition and fuel control system in accordance with one embodiment of the present invention.

Referring now to FIG. 1, a schematic block diagram of an ignition and fuel control system 10 in accordance with the present invention is shown. The ignition and fuel control system 10 includes a gaseous-fueled internal combustion engine 12, an ignition system 14, and a fuel system 16. The fuel system 16 provides fuel to engine 12 which is ignited by the ignition system 14, which in turn provides power for engine 12 to propel vehicle 18. The engine 12, although described earlier as being hydrogen fuelled, may use other fuels. A key switch 20 manually starts the operation of controller 22. The controller 22 cranks the engine 12 by signaling the starter 24 to turn the flywheel 26, which cranks the crankshaft 28. The crankshaft 28 operates a timing chain 29, which turns a camshaft 30. The controller 22 using synchronization techniques of the present invention synchronizes the ignition system 14, the fuel system 16, and the engine 12. The controller 22 using a crankshaft position sensor 32 and a camshaft position sensor 34 determines ignition stroke timing for each piston 36. The positions of the crankshaft 28 and camshaft 30 determine the position of each piston 36 in each engine cylinder 38. The position of the camshaft 30 determines whether the piston 36 in each engine cylinder 38 is on an intake or a compression stroke. Although the present invention is described as having a single control system 10 with a single controller 22, multiple controllers may be used. For example, a first controller may control the ignition system 14 and a second controller may control the fuel system 16. Of course the first controller and the second controller would need to be in communication with each other or with a third controller.

Controller 22 is preferably a microprocessor-based controller such as a computer having a central processing unit, memory (RAM and/or ROM), and associated input and output buses. Controller 22 can be a portion of the powertrain control unit (PCU) or a stand-alone fuel and ignition controller.

In a 4-stroke cycle engine, as illustrated for an embodiment of the present invention, each piston 36 has four strokes: an intake stroke, a compression stroke, an expansion or power stroke, and an exhaust stroke. The positions of the crankshaft 28 and camshaft 30 allow controller 22 to determine when a piston 36 is beginning an intake stroke or ending a compression stroke. When the piston 36 is near the beginning of an intake stroke the controller 22 signals the fuel injectors 52 to operate. The fuel injectors 52 inject fuel into the intake manifold 54, which is followed by the engine cylinders 38. Although the fuel is described as being injected into the intake manifold 54, it may also be directly injected into the cylinders 38. The controller 22 signals the spark igniter 42 to enable a sparking device 44 to create a spark in an engine cylinder 38 when ending a compression stroke. The spark ignites the fuel that was allowed to enter the engine cylinder 38 during the intake stroke to create a power stroke to drive the crankshaft. After the fuel has been ignited in an engine cylinder 38, resulting exhaust is released on the returning exhaust stroke through exhaust system 56.

Figure 2:
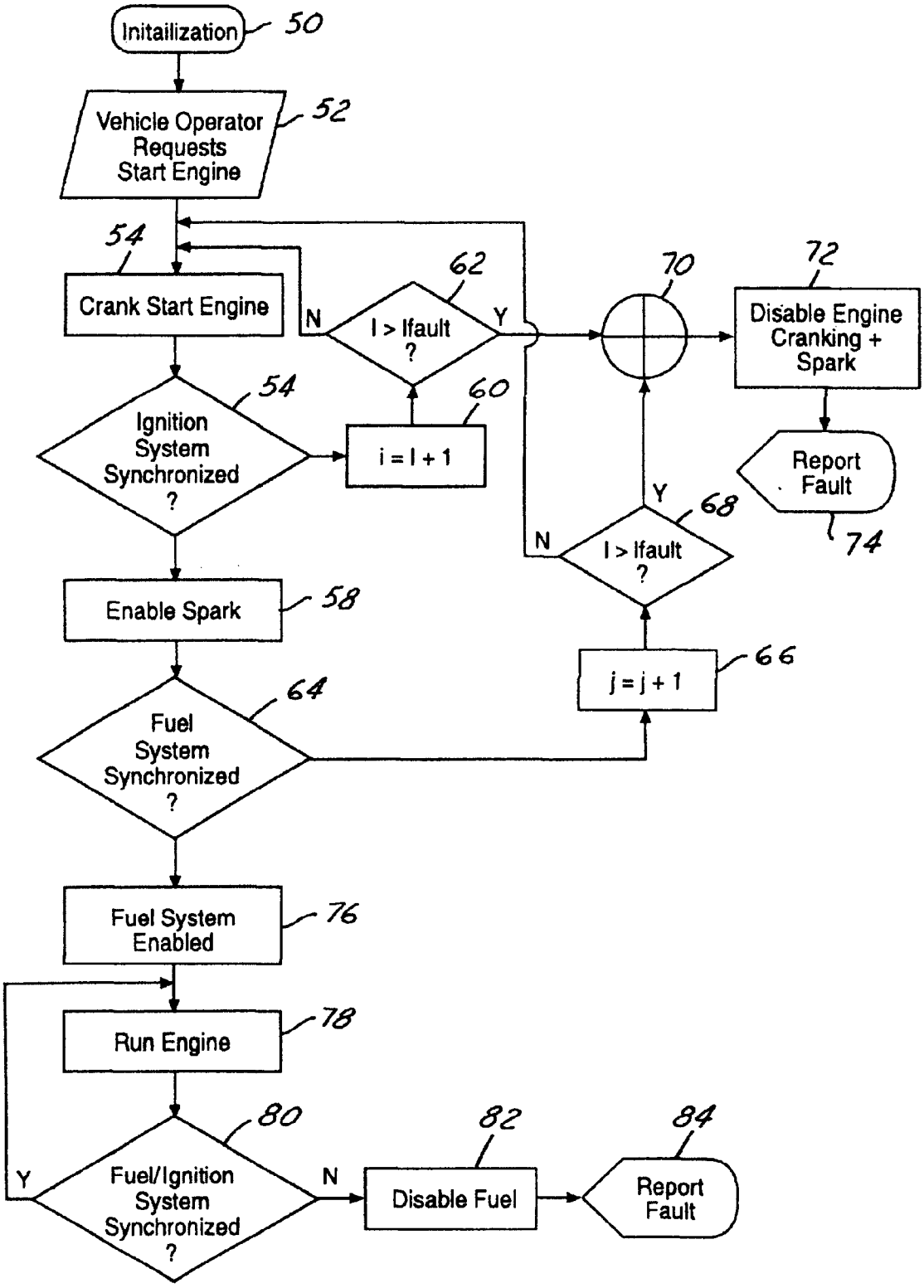
FIG. 2 is a flow chart illustrating a method of operating an ignition system and a fuel system in accordance with an embodiment of the present invention.

Referring now to FIG. 2 a flow chart illustrating a method of operating an ignition system and a fuel system in accordance with an embodiment of the present invention is shown. The control routine resides in and is executed by the controller 22 of FIG. 1.

In step 51, the ignition and fuel control system 10 is initialized. This initialization includes setting both the initial value (i) of the number of attempts to achieve spark synchronization and the initial value j of the number of attempts to achieve fuel system synchronization to zero. When the controller receives power it may then determine the position of the crankshaft and the camshaft using the crankshaft position sensor and the camshaft position sensor. Ignition reference and injection reference engine cylinders are determined in response to the crankshaft and camshaft positions, respectively. The ignition reference engine cylinder is that in which a piston is nearing the end of a compression stroke. The injection reference cylinder is that in which the piston is nearing the beginning of an intake stroke. Igniting the fuel at times other than at the end of a compression stroke may cause an undesirable hydrogen ignition outside of an engine cylinder. To prevent the undesirable hydrogen ignition, an ignition system synchronization value and a fuel system synchronization value are also determined in response to the positions of the crankshaft and camshaft.

In step 53, a vehicle operator requests for the engine to start by turning the manual key start or by other known methods.

In step 55, the controller signals the starter to crank the engine by turning the flywheel followed by performing step 86.

In step 86, the controller determines whether the crankshaft is rotating above a predetermined rotation rate. When the crankshaft is rotating above the predetermined rotation rate step 57 is performed, otherwise step 88 is performed.

In step 88, the controller signals the operator of a fault. The fault may signal the operator by any signaling method known in the art including an indicator light.

Figure 3:
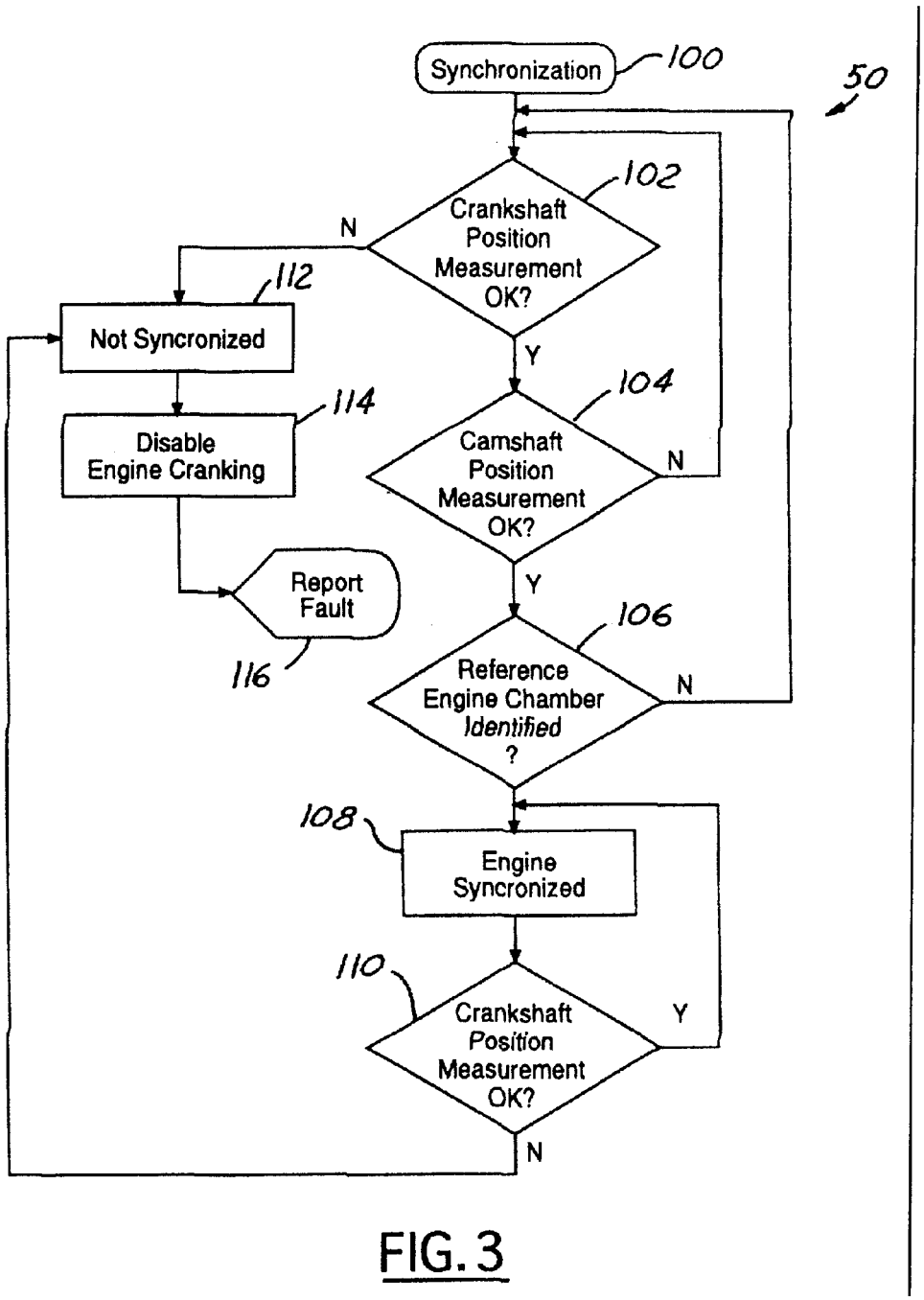
FIG. 3 is a flow chart illustrating an initialization method for the ignition and fuel control system, in accordance with an embodiment of the present invention.

In step 57 whose content is described more completely in FIG. 3, the controller determines if the ignition system is synchronized. FIG. 3 may be viewed as a procedure to determine synchronization for either ignition or fueling purposes, with appropriate changes to the reference cylinder value used. The controller, before igniting a sparking device, determines which piston is about to end a compression stroke and verifies that the igniter is properly timed to spark the sparking device corresponding to the reference engine cylinder. When the piston that is about to end a compression stroke and the igniter are synchronized the ignition synchronization value (i) remains constant. When (i) remains constant, the ignition system is synchronized with the engine and step 58 is executed, otherwise step 60 is executed.

In step 58, the controller enables the igniter to spark the sparking device that corresponds to the piston that is ending a compression stroke.

Following spark enablement during step 58, in step 59, the controller may enable the fuel rail solenoid 48 and the fuel tank solenoid 46 to allow fuel to flow to the fuel injectors 52 before fuel synchronization is determined at step 64. Step 59 may be performed any time after step 58. By performing step 59 after step 58 and before step 64, fuel lag time between when an operator requests the engine 12 to start and when fuel can first enter the cylinders 38 is reduced, thereby increasing system 10 performance.

In step 60, the ignition system synchronization value is increase by one representing that the ignition system and the engine are not synchronized.

In step 62, the ignition system synchronization value i is compared to a first predetermined value (ifault). The first predetermined value represents a value at which the controller is unable to clear or correct an ignition fault by cranking the engine.

When the ignition system synchronization value i is less than or equal to the first predetermined value, the controller returns to step 55. Otherwise, i is greater than ifault and a normally zero ignition fault flag is set to 1. The ignition fault flag value is transferred to an "OR" gate 70.

In step 64, the controller determines whether the fuel system is synchronized using the procedure of FIG. 3 with a modified reference value. Before enabling the fuel system, the controller determines which piston is about to begin an intake stroke and verifies that the fuel system is properly timed to inject fuel into the corresponding engine cylinder. When the piston that is about to end a compression stroke and the fuel system are synchronized, in the reference engine cylinder, the fuel synchronization value (j) remains constant. Step 64 and step 57 both of which use the procedure of FIG. 3 may be performed simultaneously as long as step 58 is performed before step 76, assuring that spark is enabled before the fuel injectors are enabled.

Although the present invention uses two different synchronization values, one for the ignition system and one for the fuel system, any number of synchronization values may be used. When j remains constant the fuel system is synchronized with the engine and step 76 is executed, otherwise step 66 is executed.

In step 66, the fuel system synchronization value is increased by one representing that the fuel system and the engine are not synchronized.

In step 68, the fuel system synchronization value is compared to a second predetermined value (jfault). The second predetermined value represents a value at which the controller is unable to clear or correct a fuel fault by cranking the engine.

When the fuel system synchronization value is less than or equal to the second predetermined value the controller returns to step 55. When j is greater than jfault, a normally zero fuel fault flag is set to 1. The fuel fault flag value is transferred to an "OR" gate 70.

In step 72, the controller disables engine cranking.

In step 74, the controller signals the operator of a fault as in step 88.

In step 76, the fuel system is enabled. The fuel tank solenoid and fuel rail solenoid are opened, unless they have already been opened in step 59. A fuel injector is signaled to inject fuel into the reference engine cylinder that contains the piston that is beginning an intake stroke.

In step 78, the ignition system, the fuel system, and the engine are synchronized. The controller runs the engine as known in the art. The controller continuously cycle s between step 80 and step 78 in order to continuously monitor and maintain synchronization of the ignition system, fuel system, and the engine.

In step 80, the controller verifies that t he ignition system and the fuel system are properly synchronized and supplying spark and fuel to the reference engine cylinder. When either the ignition system or the fuel system are not synchronized with the engine the controller proceeds to step 82, otherwise the controller returns to step 78.

In step 82, when the ignition system or the fuel system are not synchronized with the engine the fuel system is immediately disabled. Disabling the fuel system prevents additional fuel from entering the intake, engine, and exhaust, thereby, preventing ignition of fuel in the intake and exhaust.

In step 84, a fault is reported to the operator in the form of an electronic indicator. The electronic indicator may be any of the following: audio system, video system, heads up display, an LED in the vehicle, or any other communication method used in the art for signaling on operator of a fault.

FIG. 3 a flow chart illustrating the initialization method of step 51 above, in accordance with an embodiment of the present invention is shown.

In step 100, the system is powered "ON" and the controller begins synchronization of the ignition system, the fuel system, and the engine.

In step 102, the crankshaft position is determined. When the crankshaft position is correlated with the ignition system and the fuel system, the controller proceeds to step 104, otherwise the controller 22 performs step 112.

In step 104, the camshaft position is determined. When the camshaft position is correlated with the ignition system and the fuel system the controller proceeds to step 106, otherwise the controller returns to step 102. When step 104 has been performed consecutively more than a predetermined number of times the controller may perform step 112.

In step 106, a reference engine cylinder is identified in response to the above-determined crankshaft and camshaft positions. When the crankshaft and camshaft positions correlate to the reference engine cylinder the controller proceeds to step 108, otherwise the controller returns to step 102.

In step 108, the ignition system, the fuel system, and the engine are synchronized. The controller proceeds to step 110.

In step 110, the crankshaft position is determined to assure that the engine is still synchronized with the ignition system and the fuel system. The controller returns to step 108 when the ignition system, the fuel system, and the engine are synchronized. Step 112 is performed when the crankshaft position is not correlated with the ignition system and the fuel system, followed by steps 114 and 116.

In step 114, as in step 72, the engine is disabled from cranking.

In step 116, as in step 74, a fault is reported to the operator.

The present invention provides synchronization of the ignition system and the fuel system, which is not required in traditional gasoline fueled systems. Synchronization of the ignition system, the fuel system and the engine provides decreased ignition in the intake and exhaust systems of a vehicle. Furthermore, disabling of engine cranking, disabling of spark, and disabling of the fuel system upon determination of non-synchronization of either the ignition system or the fuel system with the engine further prevents undesired fuel ignition. Decreasing undesired fuel ignition increases the feasibility and practicality of using a power source, such as the hydrogen fueled internal combustion engine that is cleaner burning and has increased fuel efficiency over gasoline engines of current vehicle production.

The above-described method, to one skilled in the art, is capable of being adapted for various purposes and is not limited to the following applications: gasoline powered vehicles, gaseous powered vehicles including hydrogen power vehicles, hybrid vehicles, or other vehicle and non-vehicle applications. The above-described invention may also be varied without deviating from the true scope of the invention.

What is claimed is:

1. A method of synchronizing an ignition system, a fuel system, and an engine of a vehicle comprising:

determining a crankshaft position;

determining a camshaft position;

identifying a reference engine cylinder in response to said crankshaft position and said camshaft position;

determining at least one synchronization value in response to said crankshaft position and said camshaft position;

enabling said ignition system and said fuel system in response to said at least one synchronization value and said reference engine cylinder;

sensing a crankshaft rotation rate; and determining said at least one synchronization value in response to said crankshaft rotation rate comprising;

determining an ignition system synchronization value in response to said crankshaft position and said camshaft position; and determining a fuel system synchronization value in response to said crankshaft position and said camshaft position; and enabling a fuel tank solenoid and a fuel rail solenoid in response to said crankshaft rotation rate.

2. A method of synchronizing an ignition system, a fuel system, and an engine of a vehicle comprising:

determining a crankshaft position;

determining a camshaft position;

identifying a reference engine cylinder in response to said crankshaft position and said camshaft position;

determining at least one synchronization value in response to said crankshaft position and said camshaft position;

enabling said ignition system and said fuel system in response to said at least one synchronization value and said reference engine cylinder;

sensing a crankshaft rotation rate; and determining said at least one synchronization value in response to said crankshaft rotation rate comprising;

determining an ignition system synchronization value in response to said crankshaft position and said camshaft position; and determining a fuel system synchronization value in response to said crankshaft position and said camshaft position; and enabling a fuel tank solenoid and a fuel rail solenoid in response to said ignition system synchronization value.

3. A method of synchronizing an ignition system, a fuel system, and an engine of a vehicle comprising:

determining a crankshaft position;

determining a camshaft position;

identifying a reference engine cylinder in response to said crankshaft position and sad camshaft position;

determining at least one synchronization value in response to said crankshaft position and said camshaft position;

enabling said ignition system and said fuel system in response to said at least one synchronization value and said reference engine cylinder;

sensing a crankshaft rotation rate; and determining said at least one synchronization value in response to sail crankshaft rotation rate comprising;

determining an ignition system synchronization value in response to said crankshaft position and said camshaft position; and determining a fuel system synchronization value in response to said crankshaft position and said camshaft position; and enabling a fuel tank solenoid and a fuel rail solenoid in response to said fuel system synchronization value.

4. A method of synchronizing an ignition system, a fuel system, and an engine of a vehicle comprising:

deter a crankshaft position;

determining a camshaft position;

identifying a reference engine cylinder in response to said crankshaft position and said camshaft position;

determining at least one synchronization value in response to said crankshaft position and said camshaft position;

enabling said ignition system and said fuel system in response to said at least one synchronization value and said reference engine cylinder;

wherein enabling said ignition system and said fuel system further comprises;

enabling spark in at least one engine cylinder when said ignition system synchronization value is less than or equal to a first predetermined value; and then enabling fuel injection in said at least one engine cylinder when said fuel system synchronization value is less tan or equal to second predetermined value; and enabling said fuel tank solenoid and said fuel rail solenoid when said ignition system synchronization value is less than or equal to said first predetermined value and said fuel system synchronization value is greater than said second predetermined value.

5. An ignition and fuel control system of a vehicle comprising:

an ignition system;

a fuel system;

a crankshaft position sensor generating a crankshaft position signal;

a camshaft position sensor for generating a camshaft position signal;

an igniter electrically coupled to a plurality of sparking devices;

a fuel rail solenoid fluidically coupled to a plurality of fuel injectors;

a fuel tank solenoid fluidically coupled to said fuel rail solenoid; and a controller in operable communication with said ignition system, said fuel system, said crankshaft position sensor, and said camshaft position sensor, said controller determining a crankshaft position and a camshaft position in response to said crankshaft position signal and said camshaft position signal, respectively;

said controller identifying a reference engine cylinder in response to said crankshaft position and said camshaft position and generating at least one synchronization value and enabling said ignition system and said fuel system in response to said at least one synchronization value and said reference engine cylinder; and wherein said controller is electrically coupled to said igniter, said fuel rail solenoid, said plurality of fuel injectors, and said fuel tank solenoid, said control enabling said igniter, said fuel rail solenoid, and said fuel tank solenoid in response said at least one synchronization value.

6. An ignition and fuel control system of a vehicle comprising:

an ignition system;

a fuel system;

a crankshaft position sensor generating a crankshaft position signal;

a camshaft position sensor for generating a camshaft position signal;

an igniter electrically coupled to a plurality of sparking devices;

a fuel rail solenoid fluidically coupled to a plurality of fuel injectors;

a fuel tank solenoid fluidically coupled to said fuel rail solenoid; and a controller in operable communication with said ignition system, said fuel system, said crankshaft position sensor, and said camshaft position sensor, said controller determining a crankshaft position and a camshaft position in response to said crankshaft position signal and said camshaft position signal, respectively;

said controller identifying a reference engine cylinder in response to said crankshaft position and said camshaft position and generating at least one synchronization value and enabling said ignition system and said fuel system in response to said at least one synchronization value and said reference engine cylinder; and wherein said controller is electrically coupled to said igniter, said fuel rail solenoid, said plurality of fuel injectors, and said fuel tank solenoid, said controller enabling said igniter, said fuel rail solenoid, and said fuel tank solenoid in response to said at least one synchronization value; and wherein said controller signals said fuel rail solenoid and said fuel tank solenoid to enable fuel flow to said fuel injectors when an ignition system synchronization value is less than or equal to a first predetermined value and a fuel system synchronization value is greater than a second predetermined value.

7. An ignition and fuel control system of a vehicle comprising:

an ignition system;

a fuel system;

a crankshaft position sensor generating a crankshaft position signal;

a camshaft position sensor for generating a camshaft position signal;

an igniter electrically coupled to a plurality of sparking devices;

a fuel rail solenoid fluidically coupled to a plurality of fuel injectors;

a fuel tank solenoid fluidically coupled to said fuel rail solenoid; and a controller in operable communication with said ignition system, said fuel system, said crankshaft position sensor, and said camshaft position sensor, said controller determining a crankshaft position and a camshaft position in response to said crankshaft position signal and said camshaft position signal, respectively;

said controller identifying a reference engine cylinder in response to said crankshaft position and said camshaft position and generating at least one synchronization value and enabling said ignition system and said fuel system in response to said at least one synchronization value and said reference engine cylinder; and wherein said controller is electrically coupled to said igniter, said fuel rail solenoid, said plurality of fuel injectors, and said fuel tank solenoid, said controller enabling said igniter, said fuel rail solenoid, and said fuel tank solenoid in response to said at least one synchronization value; and wherein said controller signals said igniter to enable spark to a reference engine cylinder and signals said fuel rail solenoid and a fuel injector of said plurality of fuel injectors to enable fuel injection to said reference engine cylinder when said at least one synchronization value is less than or equal to a first predetermined value.

8. A system as in claim 7 wherein said controller signals said igniter to enable spark to said reference engine cylinder when an ignition system synchronization value is less than or equal to a first predetermined value.

9. A system as in claim 7 wherein said controller signals said fuel rail solenoid and one of said plurality of fuel injectors to enable fuel injection to said reference engine cylinder when a fuel system synchronization value is less than or equal to a second predetermined value.

* * * * *